US011465061B2

(12) United States Patent
Laffin et al.

(10) Patent No.: US 11,465,061 B2
(45) **Date of Patent: *Oct. 11, 2022**

(54) BOAT CAPTURE AND LAUNCH SYSTEM FOR WATER RIDES

(71) Applicant: DISNEY ENTERPRISES, INC., Burbank, CA (US)

(72) Inventors: Kristopher M. Laffin, Glendora, CA (US); Zachary Royce Kerchman, Los Angeles, CA (US)

(73) Assignee: Disney Enterprises, Inc., Burbank, CA (US)

( * ) Notice: Subject to any disclaimer, the term of this patent is extended or adjusted under 35 U.S.C. 154(b) by 472 days.

This patent is subject to a terminal disclaimer.

(21) Appl. No.: 16/789,726

(22) Filed: Feb. 13, 2020

(65) Prior Publication Data

US 2020/0179816 A1 Jun. 11, 2020

Related U.S. Application Data

(63) Continuation of application No. 15/907,391, filed on Feb. 28, 2018, now Pat. No. 10,625,168.

(51) Int. Cl.
*A63G 3/00* (2006.01)
*A63G 21/18* (2006.01)

(52) U.S. Cl.
CPC ..... *A63G 3/00* (2013.01)

(58) Field of Classification Search
CPC ... A63G 3/00; A63G 3/02; A63G 4/00; A63G 21/18; A63G 31/007
USPC ..... 472/117, 128–129, 13; 104/53, 59, 145, 104/146
See application file for complete search history.

(56) References Cited

U.S. PATENT DOCUMENTS 3,404,635 A * 10/1968 Bacon ..... A63G 3/00 104/73
10,137,377 B1 11/2018 Vance et al.
2012/0291657 A1 11/2012 Nemeth
2018/0339234 A1 11/2018 Vance et al.
2019/0262728 A1 8/2019 Laffin et al.

* cited by examiner

*Primary Examiner* — Kien T Nguyen
(74) *Attorney, Agent, or Firm* — Snell & Wilmer L.L.P.; Kent A. Lembke

(57) ABSTRACT

A system adapted for stopping and launching boats. The system includes a boat, in moving water, with an interaction member extending outward from its hull. The system includes a boat capture and launch assembly that includes: (a) a body; (b) a drive mechanism rotating the body; (c) a capture arm with a first contact surface on the body; and (d) a launch arm with a second contact surface on the body. When the body is rotated into a first position, the capture arm extends outward into the water to catch the interaction member and stop the boat. When the body is rotated through a range of second positions, the interaction member abuts the second contact surface and a launch force is applied to accelerate the boat in the direction of travel of the boat and water.

20 Claims, 7 Drawing Sheets

BOAT CENTER GUIDE POST - CAPTURED AND LAUNCHED
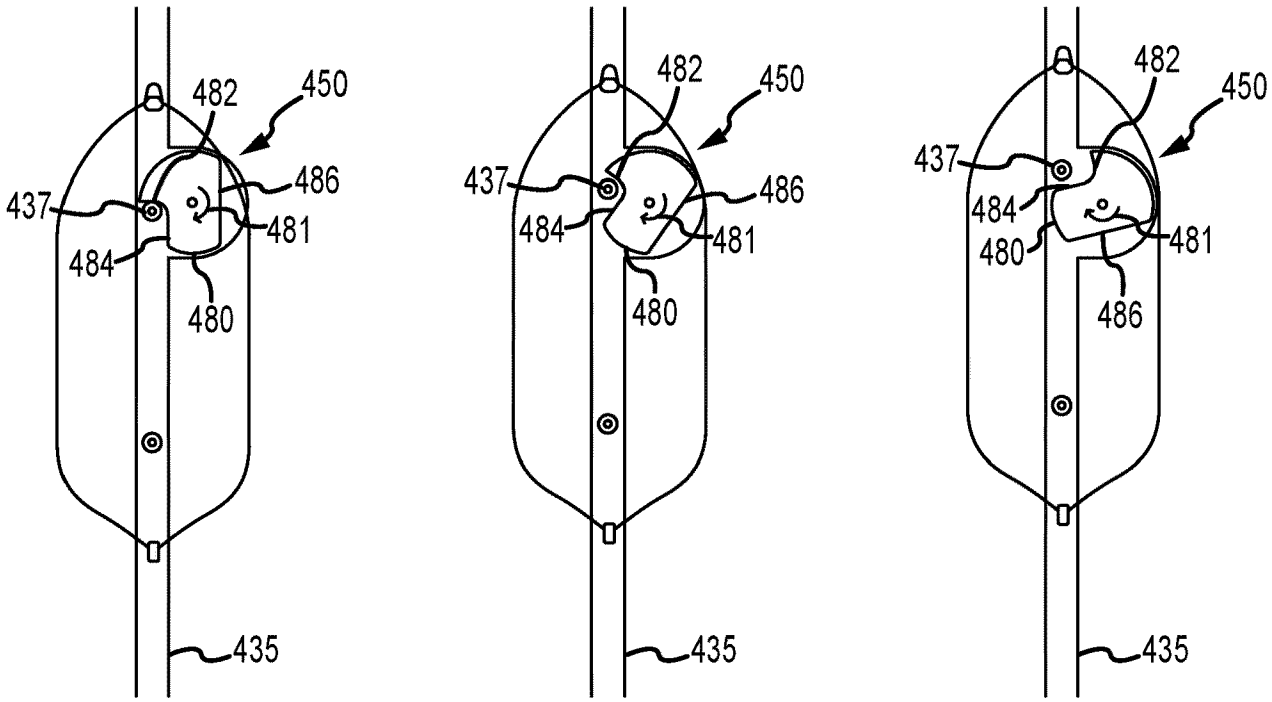
STOPPED POSITION
FIG.4C
BEGIN LAUNCH
FIG.4D
CONTINUE LAUNCH
FIG.4E
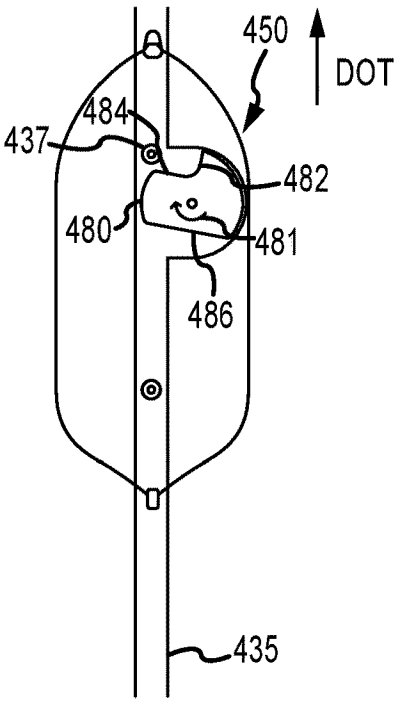
COMPLETE LAUNCH
FIG.4F

BOAT CAPTURE AND LAUNCH SYSTEM FOR WATER RIDES

REFERENCE TO RELATED APPLICATIONS

This application is a continuation of U.S. patent application Ser. No. 15/907,391, filed on Feb. 28, 2018, which is incorporated herein in its entirety by reference.

BACKGROUND

1. Field of the Description

The present description relates, in general, to, and, more particularly, to amusement and theme park rides that are water-based attractions ("water rides") in which a passenger boat (e.g., any watercraft carrying one or more passengers) floats in an untethered or free-floating manner in a water channel. More particularly, the present description relates to a system or assembly that is adapted to stop and/or capture a boat, such as at the end of a water ride for unloading and loading of passengers, and then launch or catapult the boat along the direction of travel in the channel at a desired velocity.

2. Relevant Background

Water rides have long been a staple of theme and amusement parks, and it is highly likely that the demand for these rides will continue to grow in coming years. Many water ride designs call for boats filled with passengers to travel along a channel or flume with the boats floating in the water in the channel, and the boats often will be free-floating or untethered in such water rides such that the boats generally move at the same rate as the water and in the same direction of travel as the flowing water.

In one specific example, log flumes are amusement rides including a water flume and boats that are often shaped to simulate hollow logs, and a set of guide wheels or bumpers may be provided on the boat's hull below the water line (and extend outward from the sides of the boat) to facilitate guiding of the boat along the channel as it occasionally comes into contact with the adjacent channel wall. Passengers sit in the boats as they are propelled along the flume by the flow of water. The ride may include a rapid descent and splashdown into a body of water, which may happen just before the end of the ride. In this way, water rides provide an entertaining way to get wet and cool off on a summer day. After the splashdown, the boats typically will flow along the channel some distance before entering the unloading/loading portion of the ride.

Water rides with free-floating or untethered boats often have a set of equipment designed to stop the boat at one or more locations along the ride path. This equipment is often called a boat stop, and it may be used to meter boats throughout the water ride channel for both safety and efficiency of the water ride. A conventional design for a boat stop includes a set of flipper gates or a swinging arm that is swung into the channel (e.g., perpendicular to the channel wall) to contact the leading edge of the boat or to come into contact with the guide wheels or bumpers to stop the boat in the channel and that is then swung out of the channel and the path of the boat to release the boat and allow it to move again with the flowing water.

One problem with existing boat stops is that when these boat stops release the boat, allowing the boat to advance downstream, the boat takes a significant amount of time to reach the speed that the water is moving in the flume or channel. This is due to the fact that only the thrust force of the water in the direction of flow accelerates the boat up to the nominal water speed. Such slow acceleration of the boats leaving the boat stop can create efficiency issues for the water ride, as slow moving boats keep upstream boats from advancing until the downstream boat is clear. Additionally, since water rides are generally designed with a specific dispatch interval from the loading zone, and the extra time it takes to get a boat moving again from being stopped may cause boat cascades (grouping of boats) throughout the ride, which can be undesirable as it may have a negative impact on show or ride quality and on the number of boats and, therefore, passengers that can be moved through the ride.

Hence, there is a need for improved boat stop designs that address some of the above issues with conventional flipper gate-type boat stops. Preferably, the new boat stop designs would be relatively simple to implement in existing water ride configurations such as by providing a single mechanism that is able to stop and release each boat. Further, it is desirable that the new boat stop designs work for a range of boat loadings including boats that are lightly loaded or even empty and boats loaded to full capacity (e.g., a boat full of passengers) and provide physical capture and/or blocking of the channel to ensure stopping of each boat.

SUMMARY

Briefly, the inventors designed a boat capture and launch assembly for use in water rides in place of existing boat stops. The new assembly may be thought of as a "capture-pult" because it functions both as a boat stop and as a boat accelerator or launcher when the boat is allowed to advance (e.g., from an unload/load station, metering point on ride, or the like). The boat and capture assembly may be located on a sidewall of a flume (or channel, as these terms are used interchangeably herein) in which water is flowing at a particular speed to carry boats in a direction of travel in the flume. The boat and capture assembly interacts with an interaction member(s) on the boat, which may take the form of one or more boat guide wheels that are used to guide the boat through the water flume by rolling upon flume sidewalls when the boat hull nears a side of the flume.

In one embodiment, the boat capture and launch assembly includes an elongate body supporting a capture arm and a launch (or accelerator) arm, and the elongate body may be generally cylindrical in shape with a section cut out (or removed or missing) to define the capture arm (or surface) and the launch arm (or surface), e.g., each arm is one side of the cut out section. The body may be thought of as having a cam-shaped cross section, and the body functions similar to a cam. The use of a cam-shaped and/or generally cylindrical body with capture and launch arms extending the length of the body is useful to account for differences in boat draft (i.e., the depth the boat sits in the water) due to the boat loading conditions (e.g., an empty boat versus a full boat with any number of passengers) as it ensures the boat guide wheel or other interaction member can be captured and accelerated at any expected boat draft. The capture arm is positioned into the flume/channel defined by the flume sidewalls so as to receive and capture the interaction member of a passing boat to stop the boat and keep it from advancing through the flume/channel in the direction of the water flow. For example, the capture arm may be designed to have a shape and size so that it properly contains a side guide wheel of a boat no matter where the boat is located within the flume/channel laterally (e.g., abutting sidewall containing assembly or along opposite sidewall defining the flume/channel).

When the boat is allowed (by the ride control system or other controller) to advance, a motor or actuator of the boat capture and launch assembly is operated by the control system/controller to rotate the elongate body about its center longitudinal axis. This rotation causes the interaction member to be moved from contact with the capture arm into contact with the launch arm, which also allows the boat to advance past the boat capture and launch assembly in the flume/channel. In addition, the launch arm (e.g., the second or back portion of the section cut out from the body) remains in contact with the interaction member (e.g., boat's side guide wheel) for a portion of the rotation of the body and applies a launching/catapulting force on the boat. This force accelerates the boat forward in the flume/channel along its direction of travel as the body rotates and pushes the interaction member (and attached boat hull) downstream. Since the boat capture and launch assembly is driven (by the motor or actuator), the boat no longer has to rely on only the thrust force from the flowing water as means to accelerate the boat to nominal flume velocity.

More particularly, a water ride is provided that is adapted for both stopping and launching passenger boats such as unpowered and free-floating watercraft. The water ride includes a flume assembly with a flume for containing a volume of flowing water, and the flume assembly includes a first sidewall and a second sidewall spaced a distance apart from the first defining the flume. The water ride also includes a boat positioned in the flume with a hull adapted to float in and with the water in a direction of travel, and the boat further includes an interaction member extending outward from an outer surface of the hull. Additionally, the water ride includes a boat capture and launch assembly provided on the second wall (or first wall in some cases or one may be provided in both sidewalls), and the assembly includes: (a) a body; (b) a drive mechanism operable to rotate the body about a rotation axis; (c) a capture arm with a first contact surface provided on the body; and (d) a launch arm with a second contact surface provided on the body.

In operations of the ride, when the body is rotated into a first position by the drive mechanism, the capture arm extends outward into the flume whereby the interaction member contacts the first contact surface when the boat travels in the flume adjacent the boat capture and launch assembly to stop the boat from further travel in the direction of travel. Also, during ride operations, when the body is rotated out of the first position through a range of second positions at a particular rotation rate or angular velocity by the drive mechanism, the interaction member abuts the second contact surface of the launch arm and a launch force is applied to the hull via the interaction member to accelerate the boat to travel within the flume in the direction of travel.

In some embodiments of the water ride, the interaction member includes a guide wheel extending laterally outward from a side of the hull or extending vertically downward from a bottom portion of the hull. In such embodiments, the first contact surface may be arcuate in cross sectional shape with a diameter at least as great as an outer diameter of the guide wheel. In the same or other embodiments, the capture arm and the launch arm are adjoined and may, in some exemplary but not limiting examples, form an angle in the range of 80 to 110 degrees. Additionally, the first and second contact surfaces may form a continuous surface for receiving and abutting the interaction member. In such cases, the second contact surface of the launch arm may include an inner portion proximate to the body and an outer portion distal to the body, and the outer portion may optionally have an arcuate cross sectional shape that curves away from the inner portion. Further, the second contact surface may have a length greater than a length of the first contact surface and greater than a length of the interaction member.

In some implementations of the water ride, the body has a cylindrical shape, and the first and second contact surfaces of the capture and launch arms, respectively, each have a height matching the height of the cylindrically-shaped body. In these embodiments, the height of the cylindrically-shaped body may be in the range of 50 to 100 percent of a height of the second sidewall to account for differing loading of the boat and/or changing water levels in the flume to assure contact between the capture arm and the interaction member in any of these varying conditions. Further, the boat capture and launch mechanism may include a planar guide surface provided on the body opposite the capture and launch arms, and the drive mechanism may be operable to rotate the body when operated in a non-capturing mode to position the planar guide surface to be flush with an inner surface of the second sidewall.

In the same or other embodiments, the ride may include a ride controller operating to transmit control signals to the drive mechanism to cause it to rotate the body into the first position to capture the boat and through the range of second positions at a predefined rotation rate to accelerate the boat to a predefined velocity. In these embodiments, the predefined velocity may be in the range of 50 to 150 percent of a velocity of the flowing water in the flume adjacent the boat capture and launch assembly.

BRIEF DESCRIPTION OF THE DRAWINGS

FIGS. 4A-4F provide end and side views and schematic top views during operations of another embodiment of a water ride of the present description.

DETAILED DESCRIPTION

The following description is directed toward a boat capture and launch assembly for use in water rides in which passenger boats float, typically without being tethered to be free-floating, in water flowing in a flume or channel defined by spaced apart sidewalls (as well as a bottom wall or base). The boat capture and launch assembly is mounted into or onto a sidewall defining the flume/channel and is adapted to stop (or capture) a passing passenger boat by contacting and capturing one or more interaction members on the boat's hull, e.g., a side guide wheel extending outward from the side of the boat hull. The boat capture and launch assembly is further adapted to respond to a control signal from a ride controller to both release the boat to begin moving again in the flume in the direction of travel and during this release to apply a launch or catapulting force onto the hull via the interaction member to accelerate the boat up to a desired speed or velocity (e.g., to accelerate the boat to the velocity of the water flowing in the flume/channel).

The boat capture and launch assembly presents at least two advantages over prior boat stop designs. First, the assembly or "capturepult" does not require friction to operate. Since it is directly applying force to the boat, it is a much more efficient system and can apply a much higher acceleration without any of the adverse effects of friction-based systems such as high pre-load, ride quality, and the like. Second, the assembly is not affected by the variable passenger loading of the boat. For example, one embodiment of the assembly includes a cylindrically-shaped body with a cutout section providing a capture arm and a launch arm. In this design, the same capture profile is provided along the height of the cylindrical body, and, as a result, the guide wheel (or other interaction member) will always be captured in the same way by the assembly no matter what depth the guide wheel is at within the flume/channel (e.g., due to varying passenger loading).

Additional advantages of the assembly include a drive system that can easily be located outside of the nominal flume cross section, and the drive mechanism (e.g., a motor, an actuator, or the like) can either be located above or below water level. This increases the possible devices that can be used for the drive mechanism. An above-water mechanism removes the likelihood of issues related to water intrusion into the drive while a below-water mechanism allows for better visual concealment. Further, the prior boat stop designs can significantly affect the flume water dynamics. For example, friction systems, e.g., systems with motor-driven pneumatic tires and conveyors, require a large amount of equipment to be in the nominal flume cross section, which creates drag that must be overcome in the water management design. In contrast, the boat capture and launch assembly (or capturepult system) creates much less to nearly no drag to the overall water system.

Figure 1:
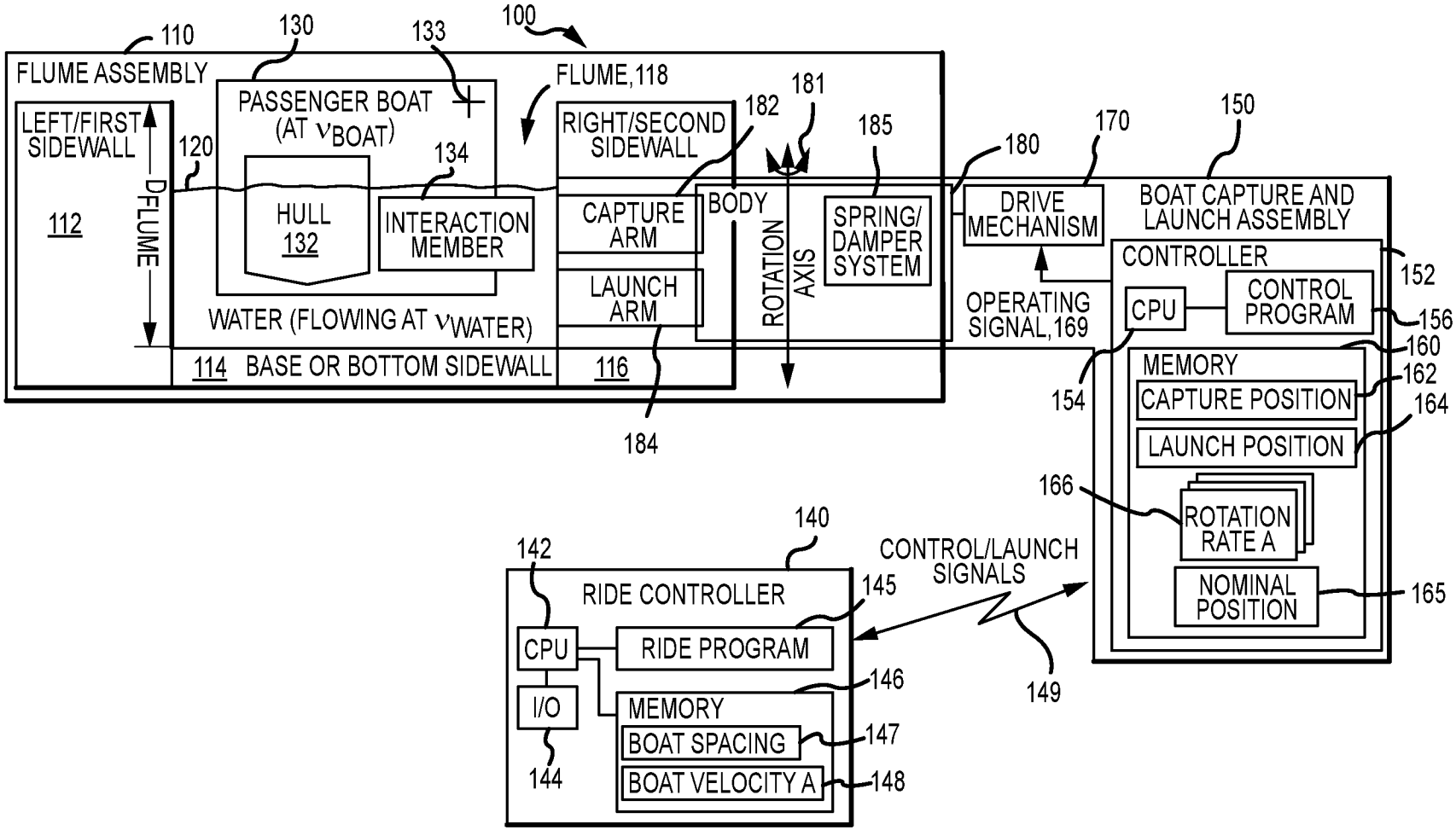
FIG. 1 is a schematic or functional block drawing of a water ride with a boat capture and launch assembly of the present description.

FIG. 1 illustrates schematically a water ride 100 that implements a boat capture and launch assembly 150 of the present description. As shown, the ride 100 includes a flume assembly 110 that includes a flume 118 filled with a volume of the water 120 that is caused or driven to flow at one or more velocities, with a water velocity, $V_{Water}$, shown at the portion of the 118 where the boat capture and launch assembly 150 is provided (such as an unload/load station, a metering section, or the like of the ride 100). The flume 118 is defined by a combination of inner surfaces of a left/first sidewall 112, a base or bottom sidewall 114, and a right/second sidewall 116, with the depth, $D_{Flume}$, of the flume 118 being set by the height of the sidewalls 112, 116 (as measured from the inner surface of the base 114 to the tops of the sidewalls 112, 116) and with the depth of the water 120 being equal to or some amount less (e.g., one to two feet or more below the tops of sidewalls 112, 116).

The water ride 100 further includes a passenger boat 130 positioned in the flume 118 to be floating on the moving water 120 in the direction of flow as shown with the arrow 133 indicating the direction of travel (DOT) of the boat 130. The boat 130 includes a hull 132, which is configured for receiving one or more passengers (not shown). An interaction member 134 is affixed to the hull 132 and typically extends outward some distance from the hull 132 such as to guide the boat's travel along the flume 118 by contacting and/or rolling upon the inner surfaces of sidewalls 112, 116 and/or the bottom wall 114. For example, the interaction member 134 may be one or more side guide wheels that extend laterally outward some distance (e.g., 6 to 24 inches or the like) from one or both sides of the hull 132 at some point below the water line (even in a no loading condition). In other cases, the interaction member 134 may be a wheel at the bottom of the boat hull 132 such as for following a track or groove in the base/bottom wall 114. In either of these two cases, the guide wheels may be affixed to the hull 132 or be extended or cantilevered out with a support post/arm. In other embodiments, the interface or interaction member 134 may be a bumper or another structural feature extending outward from a surface of the hull 132 that is adapted to contact other mechanical structures and have a stopping force and a launching force applied to it and transmit such forces to the hull 132 without (or with minimal) damage to the interaction member 134 or the hull 132.

A ride controller 140 is includes in the water ride 100 to generate control/launch signals 149 that are transmitted (in a wired or wireless manner) to the boat capture and launch assembly 150 causing it to capture and then launch the boat 130 in a timed or metered manner. To this end, the ride controller 140 includes a processor 142 that manages operations of input/output (I/O) devices 144 such as a keyboard, a mouse, a touchscreen, a voice recognition assembly, and the like to allow a ride operator to provide input such as to select and initiate a ride program 145. The ride program 145 may be a set of code or a software application executed or run by the processor 142 to provide control functions for a particular set of ride parameters set for operations of the ride 100. For example, memory 146 on controller 140 (or accessible by controller 140) may store boat spacing 147 (defined by distance and/or time between launching of boat 130 and a previous boat (not shown) or the like). The memory 146 may also store a set of boat velocities 148 that may define the desired or goal boat velocity, $V_{Boat}$, immediately after or at the end of a launch of the boat 130 by the boat capture and launch assembly 150, such as to match that of the water 120 as shown as $V_{Water}$ (or some velocity, $V_{Boat}$, greater than or less than the water velocity, $V_{Water}$, in the flume 118 adjacent to the assembly 150).

Significantly, the water ride 100 includes a boat capture and launch assembly 150, which is mounted upon and/or extends through one of the sidewalls 112, 116 (shown as extending through right/second sidewall 116). The assembly 150 is adapted to operate in response to control signals 149 from ride controller 140 to first capture/stop the boat 130 by applying a capturing/stopping force upon the interaction member 134 and then to second release and launch/catapult the boat 130 by applying a launching/accelerating force upon the interaction member 134 and, therefore, interconnected hull 132 to accelerate the boat 130 up to a desired release/launch velocity, $V_{Boat}$.

To this end, the assembly 150 includes a controller 152 that is adapted (such as with I/O devices such as a wireless transceiver) to receive and process the control signals 149 and process these via operations of a processor 154 running code/software to provide the functionality of a control program 156. The controller 152 may include memory 160 that stores a capture position definition 162 and a launch position definition 164, which together set the amount of rotation 181 of the body 180 for positioning (e.g., at preset angular position) of the capture arm 182 and the launch arm 184. The controller 152 may also retrieve a normal or nominal position 165 from memory 152 that defines a position when the assembly 150 is operated to place a portion of the body 180 flush to the wall 116, allowing boats 130 to advance through the assembly 150 without capture. Further, the memory 160 is shown as storing a set of rotation rates and/or profiles 166 for use by the controller 152 in operating, via control signals 169, a drive mechanism 170 to rotate 181 the body 180 about its rotations axis. The rotation rates 166 define how quickly the boat 130 is launched/ released form the boat capture and launch assembly 150 and helps to set the launch velocity, $V_{Boat}$, for the boat 130. A rotation rate for the body 180 can also be defined to help stop a boat 130 in a more controlled manner (i.e., "catching" a boat rather than acting as a hard stop) such as to use the motor/drive mechanism 170 to match the speed of the boat 130 with the body 180 then slow the boat 130 down and stop it by reducing the rate of rotation until the body 180 and boat 130 have stopped. The drive mechanism 170 may be nearly any motor or actuator such as an electric motor, a hydraulic or pneumatic actuator, or the like.

The body 180 may take the form of a cylinder with the arms 182, 184 extending outward from its outer surfaces or being provided by a cutout section extending the length/height of the body 180 (as shown in later figures such as with the arms 182, 184 each extending the entire length/height of the body 180 to contact the interaction member 134 at any expected loading of the boat 130 and, therefore, any expected range of depths for the interaction member 134 in the plume 118). When the body 180 is rotated 181 by the drive mechanism 170 into the capture position 162, the capture arm 182 is positioned so as to extend outward a distance (e.g., a length equal to or some amount less than the length of the interaction member 134 (e.g., about a diameter of a side guide wheel)) into the flume 118 so that the boat 130 or its interaction member 134 contacts a contact/receiving surface of the capture arm 182. The capture arm 182 is held in place by the drive mechanism 170 such that it applies a stopping force (in an upstream direction) that stops the boat hull 132 and prevents it from moving further along the flume 118 in the DOT 133. A spring and/or damper system 185 may be provided to provide a cushioned impact of the boat 130 with the capture arm 182, and the system 185 may be configured to absorb the energy of the boat 130 as it hits the capture arm 182.

Then, based on timing set out in the ride program 145, the ride controller 140 generates and transmits another control signal 149 causing the controller 152 of the assembly 150 with its control program 156 to generate another operating signal 169 to the drive mechanism 170 that causes it to rotate 181 the body 180 at a particular rotation rate and/or profile 166. This rotation 181 causes the launch arm 184 to be moved to a launch position that acts to apply a launch force upon the interaction member 134 that accelerates the boat 130 in the DOT 133 (along the flow direction of the water 120) in the flume 118 up to a desired velocity or velocity range (e.g., a range that includes the water velocity, $V_{Water}$).

In many embodiments, the contact surfaces of the capture arm 182 and the launch arm 184 are interconnected so as to define one continuous surface, which may generally be L-shaped (or with the launch arm 184 at an angle (e.g., as a non-limiting example, in the range of 80 to 110 degrees) from the capture arm 182). In this way, the interaction member 134 can be initially received or captured by the capture arm 182 and abut its contact surface. Then, as the body 180 is rotated 181 about its center longitudinal or rotation axis, the interaction member 134 moves along the contact surface of the capture arm 182 and onto the contact surface of the launch arm 184. The length and shape of the launch arm 184 then determine the amount of acceleration that is achieved by the final amount of rotation 181 of the body 180 prior to the interaction member 134 moving off an end or tip of the contact surface of the launch arm 184 (as is explained in more detail below). After launching is completed, the body 180 may be rotated back to a capture/stop position (or angular orientation) so that the capture arm 182 again has its contact surface extending outward into the water 120 in the flume 118 to stop/capture a next one of the boats 130 (e.g., this configuration of the assembly 150 always stops an approaching boat).

As can be seen from FIG. 1, the boat capture and launch assembly 150 provides a single mechanism that is able to safely and securely stop or capture a boat (e.g., any watercraft) and also to propel the boat to accelerate it to or towards a goal velocity. In other embodiments, a second assembly 150 may be provided on the opposite wall 112, and the two assemblies 150 would be controlled to act in a coordinated manner to concurrently capture the boat 130 and later launch the boat to accelerate it in the flume 118. The assembly 150 may be particularly effective for a boat 130 in which the interaction member 134 is a guide wheel extending laterally outward from the hull sides toward the inner surfaces of the sidewall 116 (or sidewall 112 if the assembly 150 is instead provided on sidewall 112).

The body 180 may be cylindrical in shape, with a solid or hollow form. The height of the body 180 is typically chosen to account for all load cases (no passengers or other load to full capacity of passengers or other load) and water depth conditions so that the interaction member 134 will always come into contact with the contact surfaces of the capture arm 182 (and then the launch arm 184 during release/launch). The arms 182, 184, in this regard, may extend the entire height of the cylindrical body 180 or some predefined portion to ensure engagement with the interaction member for any boat loading and water depth condition for the ride 100. In other embodiments, the body 180 takes other shapes that can support the arms 182, 184 and can be rotated about a rotation axis as shown with arrows 181.

As will be shown below, the catch or capture arm 182 is typically a short arm. Its length is chosen based on the dimensions/size of the interaction member such as by the diameter of a side guide wheel (e.g., the contact surface of the capture arm 182 may be greater than, equal to, or some amount less than the guide wheel diameter to avoid contact with the boat hull 132) and the guide wheel's relationship to the side of the boat hull 132. The length of the capture arm 182 is chosen so that the assembly 150 always is able to catch the boat 130 no matter its position relative to the centerline of the flume 118. In contrast, the launch arm 184 may be as long as practical to provide a longer contact surface to apply the acceleration or launch force for as much of the boat travel in the DOT 133 as possible without pinching of the interaction member 134 against the inner surface of the sidewall 116 (and to avoid hitting the hull 132). The angle formed between the contact surfaces of the capture and launch arms typically will be 90 degrees or more (e.g., 90 to 110 degrees or the like) to avoid pinching the interaction member 134 against the sidewall 116, and this is the reason that the contact surface on the launch arm 184 typically will be generally straight or linear (in profile or planar when considered along the height of the arm 184) or, in some cases, include an inner linear portion adjoining a convexly curved portion (opposite of an inner hook shape) at its end to provide the final release without pinching. The goal is to apply a launch force in a direction that is parallel to the inner surface of the sidewall 116 or even away from the sidewall 116.

In some embodiments of the boat capture and launch assembly, the assembly 150 is configured to always stop a boat with the capture arm extending into the flume after launching is completed (e.g., by additional rotation of the body/structure supporting the capture and launch arms). However, in another embodiment (as shown below), the body of the assembly may be configured as a half cylinder or other shape that includes a planar wall opposite the portion of the body containing or providing (or supporting) the two arms. Hence, the body can be positioned by the drive mechanism in three positions: (1) a boat-passing position with the planar wall flush with (or recessed from) the inner surface of the flume sidewall; (2) a capture position with the capture arm extending outward from the flume sidewall into the flume; and (3) a launch position(s) in which the launch arm is used to apply an accelerating force and then finally release the captured boat into the flume. Additionally, instead of having a planar surface on the opposite side of the capture arm, there may be an identical or similar capture arm. This would ensure that the assembly is always ready to receive the next boat and be designed for a loss of power to move the assembly.

Figure 2:
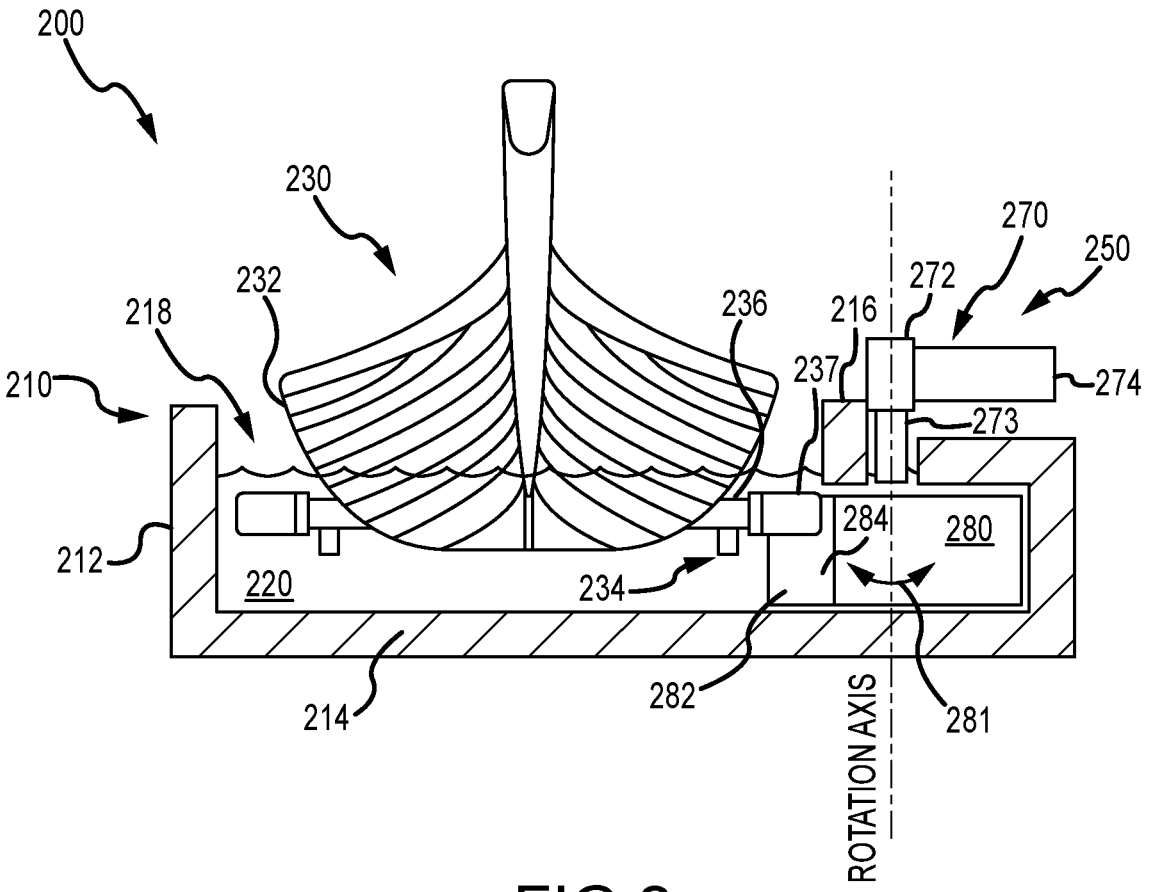
FIG. 2 is an end sectional view of a flume of a water ride with a boat capture and launch assembly such as may be used to implement the ride of FIG. 1.

FIG. 2 illustrates a water ride 200 that may be used to implement the ride 100 of FIG. 1 shown with an end cross sectional view of a flume 218 showing the aft portion of a boat 230 (looking towards the DOT for the boat 230). As shown, the water ride 200 includes a flume assembly 210 with a first/left sidewall 212, a base or bottom wall 214, and a second/right sidewall 216 defining a flume 218 with a combination of their inner or inward-facing surfaces. The flume 218 is filled with water 220 that is flowing at a velocity, $V_{Water}$, into the page of the drawing.

The water ride 200 includes a boat 230 (e.g., a passenger boat with no passengers shown in FIG. 2 for ease of illustration) in the flume 218 floating in the water 220. The boat 230 has a hull 232 that is shown to be untethered so that the boat 230 is free-floating in the flume 218 so that it is caused to move in the DOT by movement of the water 220, and, as shown, the boat 230 does not have its own propulsion system. The boat 230 is free to move side-to-side in the flume 218, and, in this regard, the boat 230 includes a set of interaction members 234 extending laterally outward from both sides of the hull 232. As shown, the interaction members 234 may each be implemented as a guide wheel assembly with a mounting bracket 236 affixed to the side of the hull 232 and extending outward some distance, and a guide wheel 237 is supported on the mounting bracket 236 to be able to freely rotate or spin about a vertical rotation axis. Hence, when the boat 230 approaches either sidewall 212 or 216, one or more of the guide wheels 237 will come into contact with the inner surfaces of that sidewall 212 or 216 and roll the hull 232 along the flume 218.

The water ride 200 includes a boat capture and launch assembly 250 that responds, as discussed with reference to ride 100, to control signals from a ride controller (not shown in FIG. 2 but understood from FIG. 1) to capture and launch the boat 230. To this end, the assembly 250 includes a cylindrical body 280 that is rotatable as shown with arrows 281 about a center rotation axis. The cylindrical body 280 includes a cutout section that defines a capture arm 282 and an adjacent and adjoining launch arm 284. The assembly 250 further includes a drive mechanism 270 to rotate 281 the body 280 to selectively position the capture arm 282 in the stop or capture position (as shown) and then to rotate 281 through a predefined angular range of travel and at a particular rotation rate and/or profile (or angular velocity) to launch the boat 230 with the launch arm 284 with a desired amount of acceleration. In this embodiment, the drive mechanism 270 is mounted above the body 280 out of the water 220, and it includes a gear box 272 and electric drive motor 274 to drive rotation of drive shaft 273, which is coupled with the body 280. Another configuration includes a remote drive system that is connected to the drive shaft 273 using a belt or chain. This configuration allows the drive system or mechanism to be located away from the flume, e.g., for evacuation and/or show/ride purposes.

In the stop/capture position shown, the capture arm 282 extends out into the flume 218 a distance such that the guide wheel 237 will come into abutting contact with the contact/receiving surface of the capture arm 282, which since the body 280 is held in position by the drive mechanism (and/or locking pin mechanism) 270 causes the boat 230 to be stopped in the flume 218 by the assembly 250. The length of the capture arm's contact surface is shown to be equal to the outer diameter of the guide wheel 237 in this embodiment, which with this flume design (its width) and the boat design (e.g., location and size of the interaction member 234) allows the capture arm 282 to capture the boat 230 when the boat 230 is proximate to the sidewall 216 and also when it is abutting the other sidewall 212 (e.g., then will contact less than all of the guide wheel diameter but an adequate interaction is achieved to stop the boat 230) but without contacting the hull 232 when the guide wheel 237 is rolling on the inner sidewall 216.

In a next operating state (not shown in FIG. 2), the assembly 250 responds to a launch control signal to launch the boat 230. This response includes the drive mechanism 270 using the motor 274 to rotate the drive shaft 273 and, therefore, body 280 via gearbox 272 as shown with arrow 281 at a predefined launch rotation rate (or angular velocity). The contact surfaces of the capture arm 282 and the launch arm 284 are adjacent (or provide one continuous surface) such that the guide wheel 237 rolls from the capture arm 282 during the rotation 281 to the launch arm 284. With further rotation 281, the guide wheel 237 rolls outward on the contact surface of the launch arm 284 from its inner portion to its release/outer portion. During this interaction, the rotation 281 of the body 280 causes the launch arm 284 to move into the flume 218 and then along the DOT of the boat 230 to apply a launching force on the hull 232 via the mating guide wheel 237, and this launch force is applied generally parallel to the inner surface of the sidewall 216 or even away from the sidewall (outward into the flume 218). As discussed above, the inner contact surface of the launch arm 284 may be planar/flat while the outer contact surface of the launch arm 284 may be convexly curved to curve away from the inner contact surface (rather than toward it in a hook-like manner that could result in undesirable pinching of the wheel 237 against the sidewall 216).

The arms 282, 284 are shown to have a height that matches that of the body 280 in the embodiment of FIG. 2. This is useful to account for different loading of the boat 230 and differing water levels in the flume 218. More specifically, the boat 230 is shown in FIG. 2 to have minimal loading so that it has only a small amount of draft. The body 280 and arms 282, 284 are shown to extend from a bottom edge near the bottom of the flume 218 (or near the inner surface of the base/bottom wall 214) to a top edge some distance below the surface of water 220 in flume 218. This enables the capture arm 282 (and launch arm 284) to fully engage the guide wheel 237 in this lightly loaded state of the boat 230. By having the body 280 and arms 282, 284 extend to near the inner surface of the base or bottom wall 214, the arms 282, 284 also will fully engage the guide wheel 237 when the boat 230 is in a fully or heavily loaded state with a much larger draft. For example, some designs may call for the height of the arms 282, 284 to be in the range of 50 to 100 percent of the distance between an anticipate water level and an inner surface of the flume base 214 (with some predefined spacing or clearance provided between the bottom edge of the arms 282, 284 and the flume base 214).

FIGS. 3A-3I are schematic top views of a water ride showing various operating states of the boat capture and launch assembly of the present description. The ride 300 is shown to include a flume assembly 310 with a flume 318 filled with flowing water 320 flowing at a particular velocity, $V_{Water}$, in the shown DOT. The flume 318 is defined by a first or left vertical sidewall 312 and a spaced apart second or right vertical sidewall 316. The inner surfaces of the sidewalls 312, 316 define a width of the flume 318 that is some amount greater than a width of a widest portion of a hull 332 of a boat 330 (e.g., a passenger boat for an amusement or theme park water-based ride) positioned in the flume 318 to float on and be moved along in a free-floating manner by water 320. To guide the boat 330 down the flume 312, interaction members in the form of side guide wheels 334, 335 are provided on both sides of the hull 332, and the guide wheels 334, 335 act to contact and roll on inner surfaces of the sidewalls 312, 316 (e.g., are pivotally mounted on hull 332) when the boat 330 floats away from the center of the flume 312 toward either sidewall 312, 316.

Figures 3A, 3B, 3C, 3D:
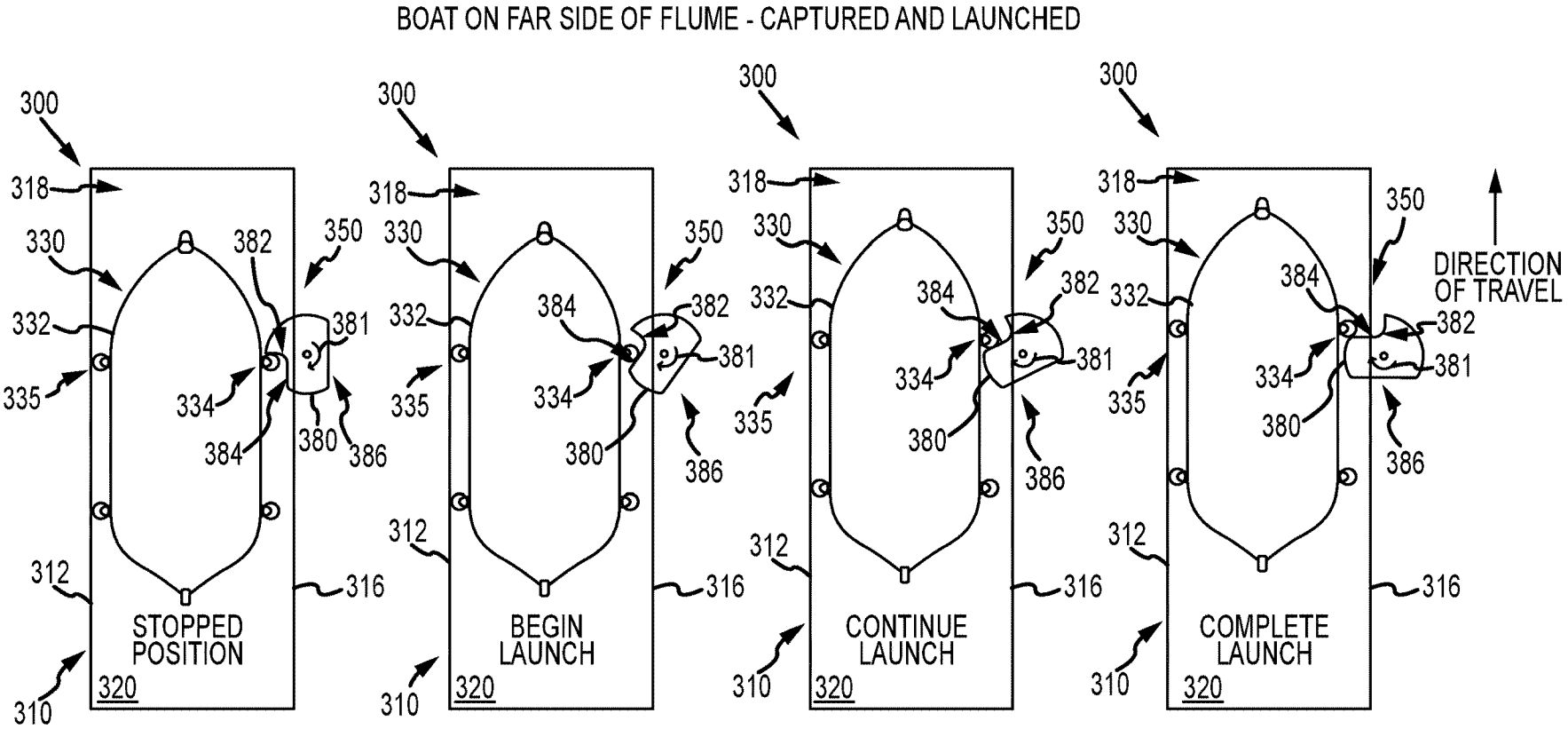
FIGS. 3A-3I are schematic top views of a water ride showing various operating states of the boat capture and launch assembly of the present description.

The water ride 300 includes a boat capture and launch assembly 350, with FIG. 3A showing it being rotated 381 into a stop/capture position. The assembly 350 includes a cylindrical body 380 that would have a height to allow it to extend from a bottom edge near the base of the flume 318 to a top edge positioned to allow capture the boat 330 at differing loading situations (as discussed with reference to FIG. 2). The body 380 includes a cutout section that defines a capture arm 382 and a launch arm 384, which has a contact surface that is adjacent and contiguous with a contact surface of the capture arm 382. As shown, the capture arm 382 has a length that is shorter than that of the launch arm (e.g., in the range of 30 to 60 percent of the launch arm length for the boat geometry shown but this will likely vary to suit different boat geometries), and it is shaped to better capture the guide wheel 334 (i.e., interaction member) to capture the boat 330 and stop it as shown in FIG. 3A. Particularly, the contact surface of the capture arm may be linear or flat or, as shown, may be curved inward (or concavely) to form a hook or arc of a circle with a diameter that matches or exceeds that of the outer diameter of the side guide wheel 334.

When the assembly 350 receives a trigger or launch signal, its drive mechanism (not shown but understood from FIGS. 1 and 2) rotates 381 the body 380 to launch the boat 330 along the flume in the DOT with an acceleration within a predefined range (such as one to accelerate the boat 330 to the velocity, $V_{Water}$, of the water in the flume 318 adjacent the assembly 350). The launching is shown in FIGS. 3B-3D. The contact surface of the launching arm 384 can be seen to include a flat or linear inner portion mating with the curved contact surface of the capture arm 382 (with the two arms 382, 384 meeting to form an angle such as one in the range of 80 to 110 degrees) and a convexly-shaped outer portion that is curved outward (or away from the inner portion). Since the contact surfaces abut each other or are continuous, the guide wheel 334 is able to simply roll off the capture arm's contact surface onto the inner portion of the contact surface of the launch arm as shown in FIG. 3B.

With additional rotation 381 at the launch rotation rate of body 380, the launch arm 384 moves further outward into the flume 318 and applies a launching force upon the hull 332 via the guide wheel 334 to move it along the DOT in the flume 312. As shown in FIG. 3C, the guide wheel 334 rolls outward onto the outer portion of the contact surface of the launch arm 384. Then, as shown in FIG. 3D, additional rotation 381 of the body 380 causes the launch arm 384 to move further out into the flume 318 and the guide wheel 334 rolls to the end and then off of the outer portion of the convexly curved contact surface of the launch arm 384 as the boat 330 is released to move in the flume 318 after being accelerated by the assembly 350.

Figure 3E:
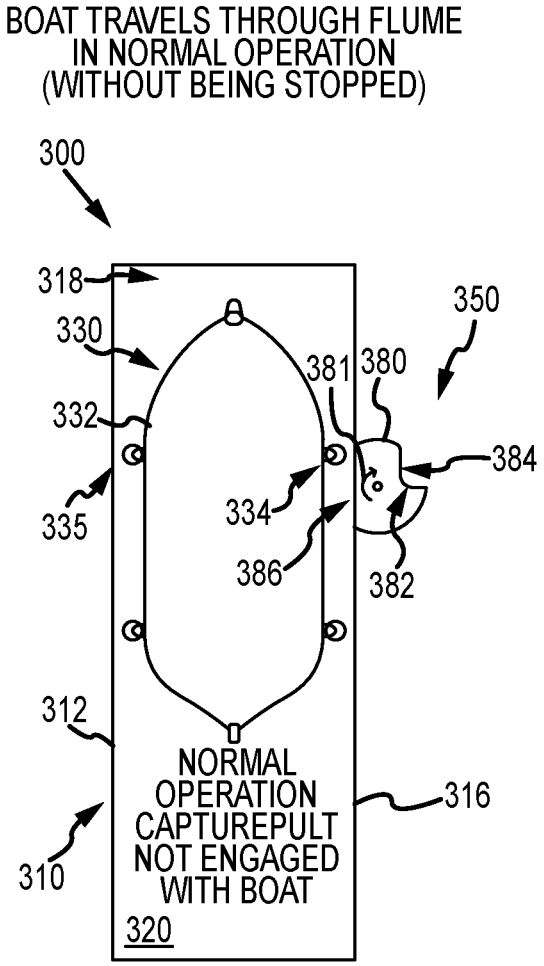
Figures 3F, 3G, 3H, 3I:
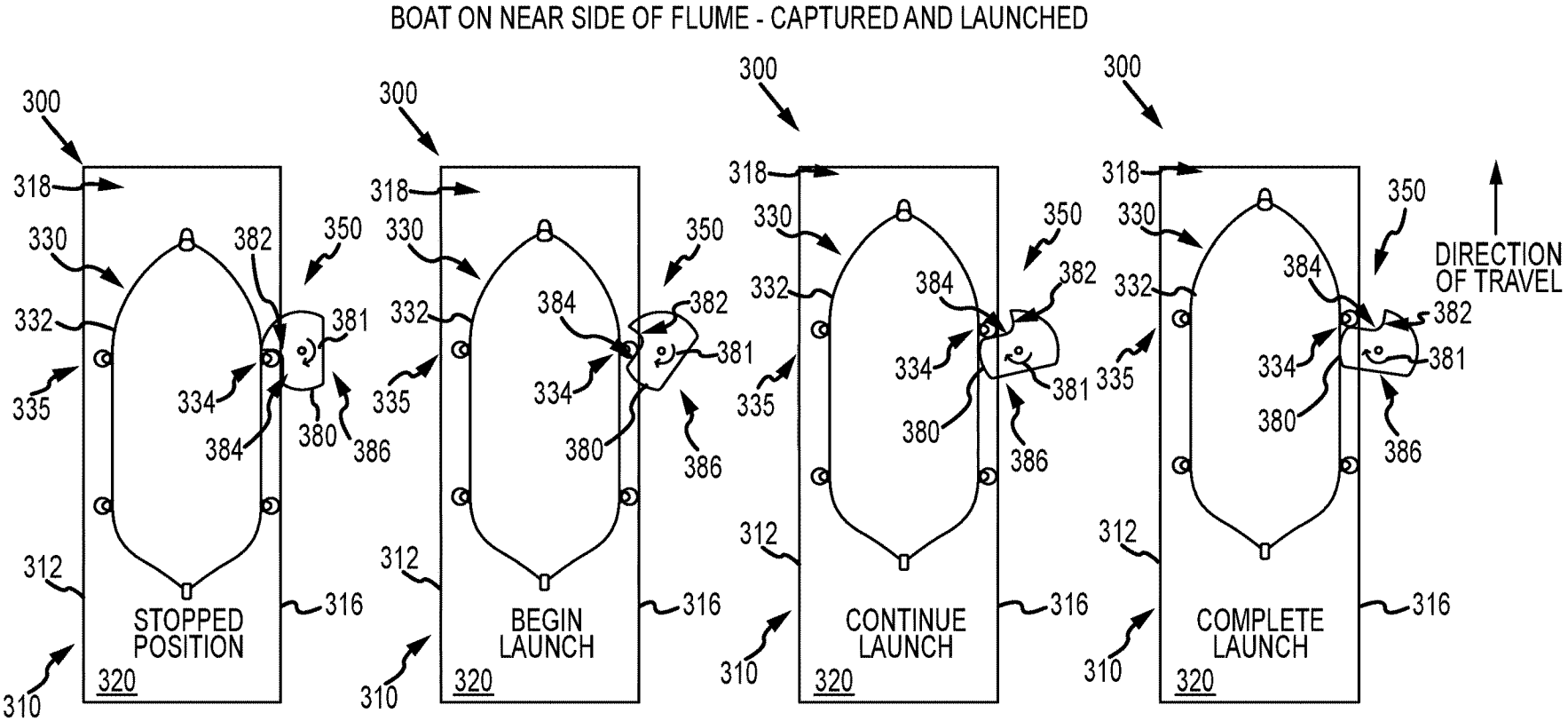

The body 380 further includes a second cutout section opposite the section providing the arms 382, 384 that defines a planar guide surface 386. FIG. 3E shows the assembly 350 after it has been rotated 381 further after the launch operations of FIGS. 3B-3D into another operating mode (e.g., a non-capture operating mode that may be useful for metering boats in the water ride 300 rather than in a load/unload station). As shown, the planar guide surface 386 is positioned relative to the adjacent sections of the sidewall 316 such that it is co-planar or flush with the inner surface of the sidewall 316. In this way, the boat's guide wheel 334 can roll over the assembly 350 without disruption or without hitting a bump that would jar the riders in the boat 330. To this end, the planar guide surface 386 will also extend the whole height of the body 380 in many embodiments and will be provided at a radius to position it to be flush with the sidewall surfaces when the body 380 is at a predefined angular orientation.

FIGS. 3A-3D illustrate operations of the ride 300 when the boat 330 has floated to the left of center of the flume 318 and towards the first/left sidewall 312 such that the left guide wheels 335 are abutting the inner surface of the sidewall 312. This is as far away from the assembly 350 as the boat 330 can go in the flume 318, and it can be seen that the capture arm 382 has a length (e.g., 80 to 120 percent of the OD of the wheel 334) that allows it to capture the side guide wheel even in this position. FIGS. 3F-3I illustrate similar operations of the ride 300 when the boat 330 has floated to the right of center of the flume 318 and towards the second/right sidewall 316 such that the right guide wheel 334 is abutting the inner surface of the sidewall 316. This is as close to the assembly 350 as the boat 330 can go in the flume 318, and it can be seen that the capture arm 382 has a length that allows it to fully engage/receive the guide wheel 334 without also contacting the hull 332 (e.g., only contact and capture the interaction member on the boat). Hence, the assembly 350 is designed to capture and then launch the boat 330 regardless of its location in the flume 318 (or the distance of its hull from the inner surface of the sidewall 316 on which the assembly 350 is provided).

Figure 4B:
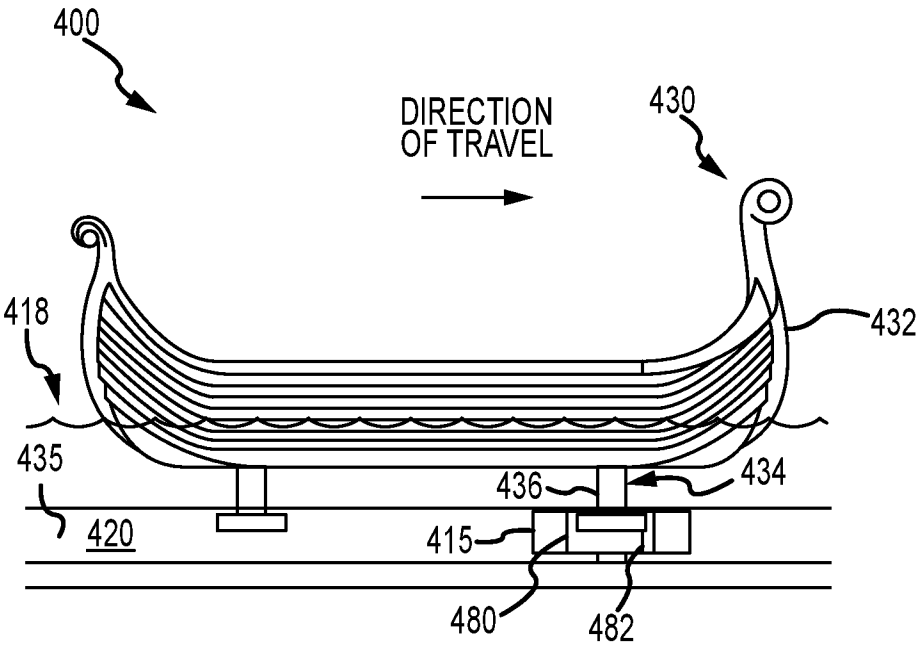
Figure 4A:
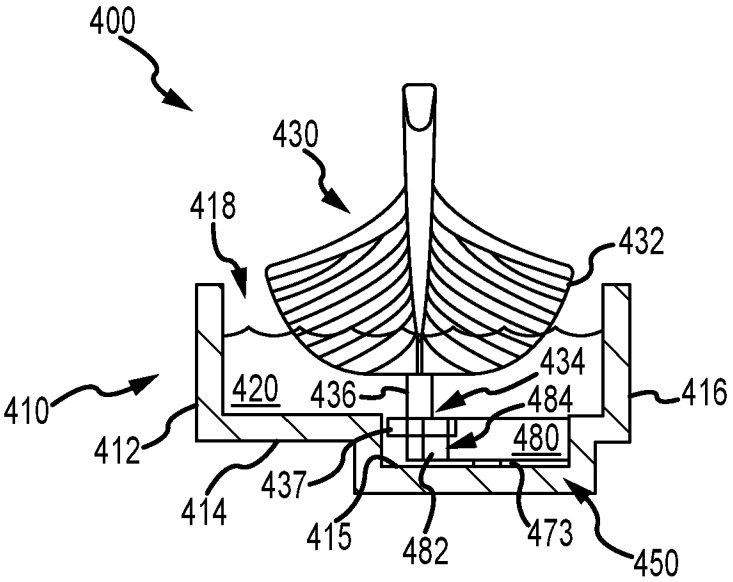

FIGS. 4A-4F provide end and side views and schematic top views during operations of another embodiment of a water ride of the present description. In some cases, the interaction member provided on the boat may not be located on the side of the boat as shown in the prior examples of FIG. 2-3I and may instead be provided on the bottom of the boat's hull such as when the boat is guided to ride in the center of the flume in a guide slot or groove. FIGS. 4A and 4B show a water ride 400 with a flume assembly 410 defining a flume 418 filled with water 420 with sidewalls 412, 416 and base or bottom wall 414. A boat 430 is positioned in the flume 418 to move with the flowing water 420 with its hull 432 floating in the water 420. On the bottom of the hull 432, the boat 430 includes one or more (two shown) interaction members 434 including a mounting post or bracket 436 extending a distance downward from the hull 432 to a pivotally coupled guide wheel 437. The bracket 436 has a length such that the guide wheel 437 is positioned within the guide slot or groove 435 when the boat 430 is lightly and heavily loaded (typically without contacting the base 414 at the bottom of the groove 435).

FIGS. 4A and 4B show the ride 400 in a stop/capture mode of operation with the boat 430 captured/stopped in the flume 418 by a boat capture and launch assembly 450. The assembly 450 may be configured to operate similarly the other assemblies described herein but be positioned to mate with the bottom-mounted interaction member 434. As shown, the assembly 450 includes a body 480 positioned within recessed portion or pit 415 in the base or bottom sidewall 414 with an opening to the groove/slot 435. A drive shaft 473 extends upward through the bottom wall 414 from a drive mechanism (not shown) to be coupled with the body 480 to allow the drive mechanism to selectively rotate the body 480 to capture and launch the boat 430.

The assembly 450 further includes a capture arm 482 and a launch arm 484 provided by a cutout section in the cylindrical body 480. The body 480 is positioned within the recessed portion/pit 415 such that when the body 480 is rotated to a first angular position the capture arm 482 (as shown) extends out into the groove/slot 415 so as to contact the guide wheel 437 and stop progress of the boat 430 in the flume 418 (with the body 480 held in position during stopping/capturing operations of the assembly 450). Then, during launching steps, the body 480 is further rotated through a range of angular positions to move the guide wheel 437 onto the launch arm 484 that is moved into the slot/groove 435 to apply an accelerating force onto the guide wheel 437 and interconnected hull 432 to move the body 430 in the DOT with a desired amount of acceleration (or to launch it at some known and desired velocity).

FIG. 4C provides top schematic view of the water ride 400 of FIGS. 4A and 4B showing the assembly 450 in the stop/capture operating mode and with it functioning to capture/stop the boat 430 in the flume 418. As shown in FIG. 4C, the guide wheel 437 is received by and contacting the contact surface of the capture arm 482, which may have an arcuate cross sectional shape such as an arc with a radius matching or exceeding that of the OD of the guide wheel 437. FIGS. 4D-4F illustrate the further rotation 481 of the body 480 to release and launch the boat 430 after the capture/stop operations end.

As shown, the contact surface of the launch arm 484 is generally planar in cross section with an arcuate or curved outer portion that curves away from the inner portion to facilitate release without pinching of the guide wheel 437. The guide wheel 437 can be seen to move/roll off the capture arm directly onto the capture arm 484, which applies a launching or accelerating force upon the boat hull 432 via the guide wheel 437 as the body 480 is rotated 481 causing the launching arm 484 to move out into and downstream in the groove/slot 435 until the guide wheel 437 rolls off the end/tip of its contact surface. The body 480 is shown to include a second cutout section to provide the planar guide surface 486 that can be positioned via rotation 481 of the body 480 to be flush with adjacent inner surfaces of the groove/slot/track 435 such as when the assembly 450 is operated in a non-capture mode and to avoid striking/capturing trailing guide wheels or other protrusions from hull 432. In other configurations, the planar surface on the opposite side of the capturepult can be the same profile/configuration of the front side. This would allow faster reset to catch the next boat, but it would not allow boats to pass through without moving the capturepult.

Although the invention has been described and illustrated with a certain degree of particularity, the particular implementations described in the present disclosure has been as examples, and numerous changes in the combination and arrangement of parts can be resorted to by those skilled in the art without departing from the spirit and scope of the invention, as claimed.

We claim:

1. A system for stopping and launching a boat, comprising:

a boat including a hull adapted to move in a direction of travel, wherein the boat further comprises an interaction member extending outward from an outer surface of the hull; and a boat capture and launch assembly comprising:

a body;

a drive mechanism operable to rotate the body about a rotation axis;

a capture arm with a first contact surface provided on the body; and a launch arm with a second contact surface provided on the body, wherein when the body is rotated into a first position the capture arm extends outward whereby the interaction member of the boat contacts the first contact surface when the boat travels adjacent the boat capture and launch assembly, and wherein when the body is rotated out of the first position through a range of second positions a second contact surface of the launch arm abuts the interaction member and a launch force is applied to the hull via the interaction member to accelerate the boat to travel in the direction of travel.

2. The system of claim 1, wherein the interaction member includes a guide wheel extending laterally outward from a side of the hull or extending vertically downward from a bottom portion of the hull.

3. The system of claim 1, wherein the boat capture and launch assembly stops the boat from further travel when the first contact surface contacts the interaction member when the body is rotated into the first position and wherein the capture arm and the launch arm are adjoined and form an angle in the range of 80 to 110 degrees.

4. The system of claim 1, wherein the first and second contact surfaces form a continuous surface for receiving the interaction member.

5. The system of claim 4, wherein the second contact surface of the launch arm comprises an inner portion proximate to the body and an outer portion distal to the body, the outer portion having an arcuate cross sectional shape that curves away from the inner portion.

6. The system of claim 1, wherein the body has an elongated shape, wherein the first and second contact surfaces of the capture and launch arms, respectively, each have a height matching a height of the body.

7. The system of claim 6, wherein the height of the body is in the range of 50 to 100 percent of a height of a sidewall of a flume containing water flowing in the direction of travel of the boat.

8. The system of claim 1, wherein the boat capture and launch mechanism further comprises a planar guide surface provided on the body opposite the capture and launch arms and wherein the drive mechanism is operable to rotate the body when operated in a non-capturing mode to position the planar guide surface to be flush with an inner surface of a sidewall of a flume containing water flowing in the direction of travel of the boat.

9. The system of claim 1, further comprising a ride controller operating to transmit control signals to the drive mechanism to cause it to rotate the body into the first position to capture the boat and through the range of second positions at a predefined rotation rate or drive profile to accelerate the boat to a predefined velocity or to stop the boat in a controlled manner during movement through a subset of the second positions.

10. The system of claim 9, wherein the predefined velocity is in the range of 50 to 150 percent of a velocity of flowing water adjacent the boat capture and launch assembly.

11. A method for stopping and launching boats, comprising:

in water flowing a direction of flow, providing a boat with a hull and an interaction member extending outward from the hull;

positioning in the water an assembly comprising a support structure;

rotating the support structure about a rotation axis, wherein the support structure includes a capture arm with a first contact surface extending from the support structure and further includes a launch arm with a second contact surface extending from the support structure, first rotating the support structure to a first position to cause the first contact surface of the capture arm to extend outward a distance whereby the first contact surface abuts and captures the interaction member when the boat travels proximate to the support structure, and second rotating the support structure from the first position through a range of second positions causing the second contact surface of the launch arm to contact the interaction device and apply a launch or acceleration force upon the boat that is along the direction of flow of the water.

12. The method of claim 11, wherein the first rotating is performed so that when captured so as to stop further travel of the boat in the direction of flow of the water near the assembly.

13. The method of claim 11, wherein the interaction member includes a guide wheel extending laterally outward from a side of the hull or extending vertically downward from a bottom portion of the hull and wherein the first contact surface is arcuate in cross sectional.

14. The method of claim 11, wherein the first and second contact surfaces of the capture arm and the launch arm meet to form an angle and wherein the first and second contact surfaces form a continuous surface.

15. The method of claim 14, wherein the second contact surface of the launch arm comprises an inner portion proximate to the support structure and an outer portion distal to the body, the outer portion having an arcuate cross sectional shape that curves away from the inner portion.

16. The method of claim 11, wherein the support structure comprises a cylindrically-shaped body, wherein the first and second contact surfaces of the capture and launch arms, respectively, each have a height matching the height of the cylindrically-shaped body, wherein the assembly further comprises a planar guide surface provided on the body opposite the capture and launch arms, and wherein the drive mechanism is operable to rotate the body when operated in a non-capturing mode to position the planar guide surface to be flush with an inner surface of one or more sidewalls of a flume containing the water.

17. The method of claim 11, further comprising operating a ride controller to transmit control signals to a drive mechanism to cause it to rotate the support structure into the first position to capture the boat and through the range of second positions at a predefined rotation rate or drive profile to accelerate the boat to a predefined velocity.

18. A system for stopping and launching passenger boats, comprising:

a capture arm with a first contact surface;

a launch arm with a second contact surface meeting with the first contact surface to form a single continuous surface and to define an angle that is greater than 80 degrees;

a body supporting the capture arm and the launch arm; and a drive mechanism first operating to rotate the body to a first position with the first contact surface of the capture arm extending outward and second operating to rotate the body from the first position through a series of second positions, wherein, after the first operating when a boat travels in a direction of travel in water adjacent the body and during the second operating and after the capture arm has captured the interaction member, the interaction member moves from the first contact surface to the second contact surface, whereby the launch arm applies a force on the interaction member that propels the boat to travel in the direction of travel in the water at a velocity within a predefined range of velocities.

19. The system of claim 18, wherein, after the first operating when a boat travels in a direction of travel in in water adjacent the body, the capture arm captures an interaction member on the boat by applying a second force on the interaction member with the first contact surface that resists further travel of the boat in the direction of travel.

20. The system of claim 18, wherein the second contact surface of the launch arm comprises an inner portion proximate to the body and an outer portion distal to the body, the outer portion having an arcuate cross sectional shape that curves away from the inner portion.

* * * * *